United States Patent [19]

Clark et al.

[11] 4,295,229

[45] Oct. 20, 1981

[54] FOOTBALL GLOVES

[76] Inventors: Eugene A. Clark, 27 Blen Cathia Hill, R.R. 2, Gormley, Ontario, Canada, L04 1G0; Morris Zubkewych, 2184 D Bloor St. W., Toronto, Ontario, Canada

[21] Appl. No.: 122,418

[22] Filed: Feb. 19, 1980

[51] Int. Cl.[3] ..... A41D 13/08

[52] U.S. Cl. ..... 2/20; 2/161 A

[58] Field of Search ..... 2/20, 161 A

[56] References Cited

U.S. PATENT DOCUMENTS

| | | | |
|---|---|---|---|
| 2,554,991 | 5/1951 | Kramer | 2/161 A |
| 3,228,035 | 1/1966 | Davis | 2/161 A |
| 3,606,614 | 9/1971 | Dimitroff | 2/20 X |
| 3,882,548 | 5/1975 | Shinagawa et al. | 2/161 A |
| 3,890,649 | 6/1975 | Diggins | 2/161 A |
| 4,042,975 | 8/1977 | Elliott et al. | 2/161 A |
| 4,051,553 | 10/1977 | Howard | 2/20 X |

*Primary Examiner*—Louis Rimrodt

[57] ABSTRACT

The present invention provides a padded, flexible football glove which includes a wrist protecting portion and a hand protecting portion. The hand protecting portion is provided with individual elastic finger and thumb receptacles. The finger receptacles are connected via a common restraining strip of material to restrain excessive stretching of the finger receptacles while the thumb receptacle is provided with its own restraining strip. The thumb pad is webbed to the finger pad to limit the movement of the thumb pad. The glove is further provided with a plurality of transverse flexible joints to permit its flexing and securing means at both the hand protecting portion and the wrist protecting portion to secure the glove in position.

8 Claims, 4 Drawing Figures

FIG.1.
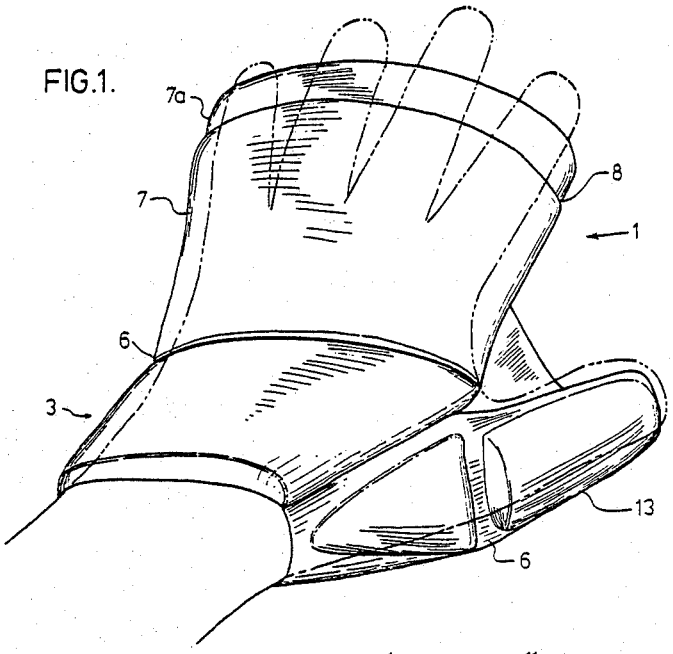
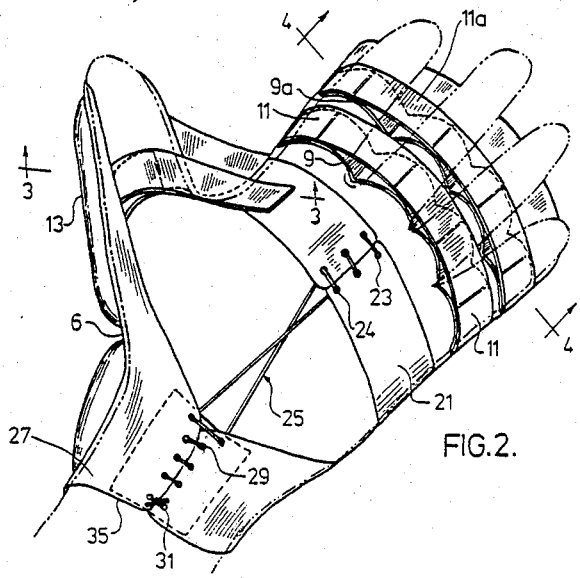
FIG.2.

FOOTBALL GLOVES

FIELD OF THE INVENTION

The present invention relates to a football glove intended to be primarily used by both offensive and defensive linemen.

BACKGROUND OF THE INVENTION

According to conventional practice, football linemen, both offensive and defensive, generally tape their hands to help reduce injuries. However, this taping is both time consuming and uneconimical because the tape is not reuseable. Furthermore, removing the tape is not pleasant whatsoever, because it sticks directly to the skin and must be pulled or torn off.

In addition, to the above drawbacks, hand taping is not generally effective for fully protecting the hand while permitting use of the hand, i.e., a tape job that is applied well enough to protect the hand also limits the flexibility of the hand and overly restricts use of the fingers and thumb. Such restrictions present a problem because they limit the linesman's ability to either ward off or restrict the progress of an opponent. Furthermore, even though a lineman does not often get an opportunity to handle a football, he must have freedom of movement of the hands on those few occasions where there is an opportunity to recover a fumble and the like.

There is presently available, a relatively little used alternative for hand taping. This alternative is in the form of a striking glove used in practise by boxers. Although, these striking gloves do allow for greater hand movement than a good tape job, they do not provide adequate protection and as such, have met with very limited success on the football field. They simply cover the back surface of the hand and barely the first knuckle of the fingers and thumb so that essentially the entirety of the fingers and all of the thumb, extend beyond the end of the glove where they are exposed to damage. In addition, with these boxing gloves, the thumb is totally freely moveable, independently of the fingers and therefore, very easily dislocated or broken. These finger tip boxer striking gloves are held on the hand by drawstrings which are pulled directly into tight contact with the player's wrist so that they are extremely uncomfortable and often cut off the circulation in the wrist, which can cause compression of the median nerve.

The football glove of the present invention has been designed to provide both the required protection and flexibility to the hands of a football player. The glove which is padded, includes both a wrist protecting portion and a hand protecting portion. The hand protecting portion is provided with finger and thumb pads which cover at least the first phalange of the fingers and thumb. This reduces the exposure of the fingers and thumb to damage and at the same time, allows adequate exposure for using the hands in either dealing with an opponent or grasping a free ball.

The thumb pad is connected to the finger pad by web means which limits movement of the thumb pad and helps to prevent serious dislocations to the thumb. Each of the finger and thumb pads is provided with individual elastic, downwardly hanging finger and thumb receptacles which again permit use of the fingers and thumb. Restraining means is provided to restrain excessive stretching of the elastic finger and thumb receptacles for purposes of reducing injuries to the fingers and thumbs.

The glove is provided with a plurality of transverse flexible joints along its length to permit flexing of the overall glove. It additionally includes securing means at both the hand protecting portion and the wrist protecting portion to secure the glove in position.

This securing means is in a form which is comfortable to the user and will not cut off circulation to the hands.

BRIEF DISCUSSION OF THE DRAWINGS

The above, as well as other advantages and features of the present invention will become more apparent according to the preferred embodiments of the present invention wherein;

FIG. 1 is a top perspective view of a preferred embodiment of a football glove according to the present invention;

FIG. 2 is a bottom perspective view of the glove of FIG. 1;

Figure 3:
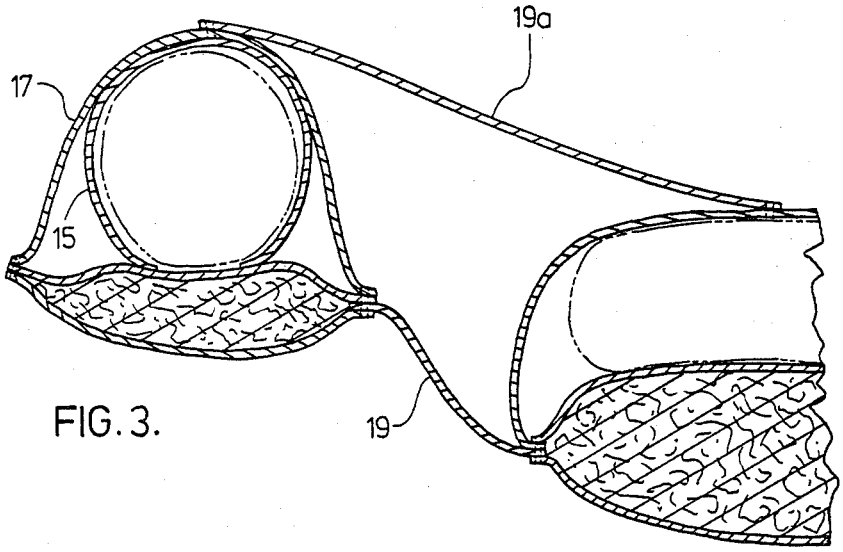
FIG. 3 is a sectional view taken along the lines 3—3 of FIG. 2.

DETAILED DESCRIPTION ACCORDING TO THE PREFERRED EMBODIMENTS OF THE PRESENT INVENTION

Referring first, to FIG. 1, the football glove comprises a hand protecting portion generally indicated at 1 and a wrist protecting portion generally indicated at 3. When the glove is fitted over the hand of the football player, wrist portion 3 extends rearwardly from the hand over the wrist of the player while portion 1 extends forwardly over the back of the hand and along the fingers, to protect the metacarpalphalange joints which are covered by pads 7 and *7a* of the glove. The glove shown in the drawings is dimensioned such that only the last phalange of the fingers extends beyond the finger pad portion *7a* whereby the entirety of the back of the hand, the back of the wrist and the fingers rearwardly from the last phalange are protected via the glove.

This particular glove is adapted for use by offensive linemen who require only minimal finger exposure. However, defensive linemen may require somewhat more use of the hands and in the case of a defensive lineman glove, the last two phalanges extend beyond the finger pads such that only the first phalange is covered which still provides adequate protection for the fingers and thumb.

Figure 4:
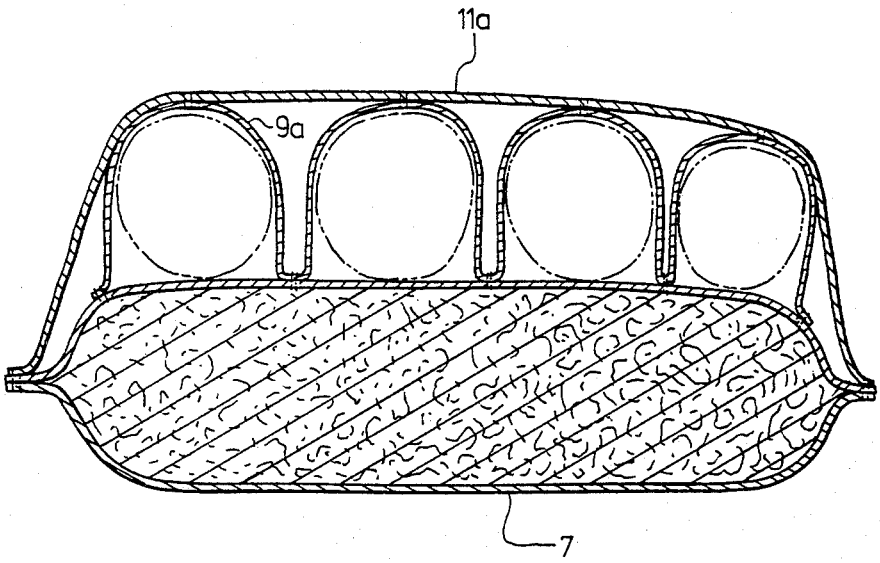
FIG. 4 is a sectional view taken along the lines 4—4 of FIG. 2.

The finger pad portion of the glove is formed by portions 7 and *7a* which are provided with hanging loop finger receptacles 9 and *9a* respectively. These finger loops are made from two-way stretch material so that they not only accommodate various sizes of fingers, but at the same time, permit flexing and use of the fingers once they are inserted into the loops. However, in order to prevent unlimited stretching of the finger loops which could result in injuries to the fingers, restraining strips of inelastic material 11 and *11a* are provided to limit the amount of stretching of loops 9 and *9a*. Each of these restraining straps is secured slackly across an entire row of finger loops as shown in FIG. 4, such that it is common to adjacent loops. As is also shown in FIGS. 2 and 4, the restraining strap is secured for example, by sewing it to the central portion of each of the loops.

Each of the restraining straps permits adequate stretching of the finger loops to allow a desired amount of movement to each of the fingers. However, the straps prevent stretching beyond an unacceptable limit at which the fingers could be damaged.

The hand protecting portion of the glove is secured to the wrist protecting portion via a flexible joint 6 which permits flexing of the hand relative to the wrist. A second flexible joint 8 is provided directly in the hand protecting portion between finger pad sections 7 and 7*a*. Joint 8 permits bending of the main knuckles in the fingers to further enhance the flexibility of the glove.

Also provided on the hand protecting portion is a thumb pad which also flexes at joint 6. Provided on the underside of the thumb pad is a thumb receptacle 15 which is made from the same two-way stretch material as the finger loops. The thumb receptacle or loop 15 is restrained against excessive stretching via restraining strap 17 which is secured slackly across the thumb loop. Restraining strap 17 performs the same function as straps 11 and 11*a* in that it permits stretching of the thumb loop only to the extent that the thumb is useable to assist the fingers in grabbing a free football or warding off an opponent but prevents unlimited movement of the thumb which could cause injuries.

One of the most commonly found injuries to the hand is thumb dislocation which is caused when the thumb is excessively separated from the fingers. The glove, according to the present invention is provided with web means interconnecting the thumb pad with the finger pad to prevent just such an injury. This web means is in the form of leather webbing portions 19 and 19*a*, secured to the upper and lower surfaces respectively, of the thumb pad. The leather webbing is again, slack when the hand is in a normal position to allow movement of the thumb independently of the fingers. However, the webbing prevents undue separation of the thumb pad from the finger pad to substantially eliminate thumb dislocations.

For purposes of securing the glove in position, both the hand covering portion and the wrist covering portion are provided with lower covers or lips 21 and 27 respectively. Lower cover 21 is provided with a plurality of tie-string receiving openings 23 which are reinforced by metal eyelets 24. Cover 27 extending downwardly from the wrist pad is also provided with tie-string receiving openings indicated at 29 and reinforced by metal eyelets 31. Covers 21 and 27 are arranged such that a tie-string 25 is first fitted through the openings in protective cover 21 and then through the opening in cover 27 so that it is common to both the hand protecting portion and the wrist protecting portion of the glove. The glove is held securely in position on the hand of the football player by drawing the common tie-string 25 in tightly, at both the hand and the wrist. An interior protective cover 35 lying directly against the skin beneath the tie-string permits substantial tightening of the string without cutting off circulation to either the wrist or the hand by isolating the string from direct contact with the hand or wrist inserted into the glove. Therefore, the glove can be held both comfortably and securely in place on the hand while playing.

As will now be well understood from the description above, the football glove of the present invention has been designed to meet both the flexibility and the protective requirements of an offensive or defensive lineman. Furthermore, although various preferred embodiments of the invention have been described herein in detail, it will be apparent to one skilled in the art that variations may be made thereto, without departing from the spirit of the invention or the scope of the appended claims.

The embodiments of the invention in which an exclusive property or privilege is claimed are defined as follows:

1. A football glove including an upper pad arrangement comprising a wrist protecting portion and a hand protecting portion integrated with one another with said hand protecting portion being partially open from beneath for palm, finger and thumb exposure below said pad arrangement, said hand protecting portion being provided with finger and thumb pads of a length such that there is at least first phalange finger and thumb coverage from above by said finger and thumb pads, inelastic web means connecting the thumb pad to the finger pads to limit movement of said thumb pad away from said finger pads, individual finger and thumb receptacles beneath said finger and thumb pads, said receptacles being adapted for limited stretching thereof to enable ready finger and thumb manipulation and being provided with restraining means for restraining excessive stretching of said receptacles to reduce finger and thumb injuries, said pad arrangement being provided with a plurality of transverse flexible joints along its length to permit flexing of the glove in said hand protecting portion and between said hand protecting portion and said wrist protecting portion and separate securing means at both said hand protecting portion and said wrist protecting portion to secure said glove in position from beneath said pad arrangement.

2. A football glove as claimed in claim 1 wherein said web means connecting the thumb pad to the finger pad includes upper and lower web portions.

3. A football glove as claimed in claim 1 wherein said finger and thumb receptacles comprise loops of elastic material hanging down beneath said finger and thumb pads.

4. A football glove as claimed in claim 3, wherein said restraining means to restrain excessive stretching of said elastic finger and thumb receptacles comprise strips of inelastic material secured slackly across the loop of material hanging downwardly from said finger pads and thumb pad.

5. A football glove as claimed in claim 4 wherein the strip of inelastic material secured slackly across the finger receptacles is common to all of the finger receptacles.

6. A football glove as claimed in claim 1, wherein both said hand protecting portion and said wrist protecting portion are provided with lower covers, said securing means comprising a tie-string, which is tied over said lower covers and isolated from a hand and a wrist secured in said glove by said lower covers.

7. A football glove as claimed in claim 1 wherein said glove is provided with a flexible joint between the wrist protecting portion and the hand protecting portion.

8. A football glove as claimed in claim 7, wherein said finger and thumb pads are of a length such that there is only last finger and thumb phalange extension beyond the finger and thumb pads and including a second flexible joint along the finger pad.

* * * * *